US011521815B2

(12) United States Patent
Carlson et al.

(10) Patent No.: US 11,521,815 B2
(45) Date of Patent: Dec. 6, 2022

(54) DETECTING A POSITION OF AN ARMATURE IN AN ELECTROMAGNETIC ACTUATOR

(71) Applicant: Rockwell Automation Technologies, Inc., Mayfield Heights, OH (US)

(72) Inventors: Andrew E. Carlson, Franklin, WI (US); Kyle B. Adkins, Oak Creek, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 128 days.

(21) Appl. No.: 16/929,946

(22) Filed: Jul. 15, 2020

(65) Prior Publication Data

US 2022/0020549 A1 Jan. 20, 2022

(51) Int. Cl.

| | |
|---|---|
| ***H01H 47/00*** | (2006.01) |
| ***H01H 47/22*** | (2006.01) |
| ***H01H 47/32*** | (2006.01) |
| ***H01H 50/18*** | (2006.01) |

(52) U.S. Cl.

CPC ..... *H01H 47/32* (2013.01); *H01H 47/002* (2013.01); *H01H 50/18* (2013.01)

(58) Field of Classification Search

CPC ..... H01H 47/22; H01H 47/32; H01H 47/325; H01H 47/002; H01H 2047/003; H01H 47/004; H01H 2047/006; H01H 50/18–20

See application file for complete search history.

(56) References Cited

U.S. PATENT DOCUMENTS

| | | | | |
|---|---|---|---|---|
| 4,809,742 | A | 3/1989 | Grau | |
| 5,724,223 | A * | 3/1998 | Feuser | H01H 47/325 361/152 |
| 5,942,892 | A | 8/1999 | Li | |
| 6,249,418 | B1 | 6/2001 | Bergstrom | |
| 2003/0160517 | A1* | 8/2003 | Lo | H01H 47/223 307/140 |
| 2003/0174429 | A1* | 9/2003 | Heydt | G11B 21/21 360/75 |

(Continued)

FOREIGN PATENT DOCUMENTS

| | | | | |
|---|---|---|---|---|
| CN | 105137761 | A * | 12/2015 | |
| CN | 109845084 | A * | 6/2019 | H02P 6/085 |

(Continued)

OTHER PUBLICATIONS

English translation of "CN-2108376000" Tang Rong , Magnetic Latching Relay Driving Device (Year: 2020).*

(Continued)

*Primary Examiner* — Sisay G Tiku

(74) *Attorney, Agent, or Firm* — Fletcher Yoder, P.C.

(57) ABSTRACT

A system may include an armature configured to move between a first position that electrically couples the armature to a first contact and a second position that electrically couples the armature to a second contact. The system may also include a coil configured receive a current, such that the current conducting in the coil is configured to magnetize a core. The magnetized core may cause the armature to move from the first position to the second position. The system may also include a control system configured to detect a position of the armature based on an inductance of the coil.

18 Claims, 8 Drawing Sheets

(56) References Cited

U.S. PATENT DOCUMENTS

| | | | | |
|---|---|---|---|---|
| 2004/0016461 | A1* | 1/2004 | Qu | G05B 19/19 137/554 |
| 2014/0049114 | A1* | 2/2014 | Chen | H01H 47/22 307/75 |
| 2014/0117911 | A1* | 5/2014 | Lamprell | H01F 7/1844 318/490 |
| 2014/0354269 | A1* | 12/2014 | Stevens | H01F 7/1844 324/207.16 |
| 2018/0080799 | A1 | 3/2018 | Creech et al. | |
| 2018/0151321 | A1* | 5/2018 | Gorenflo | H01H 51/27 |
| 2019/0326907 | A1 | 10/2019 | Schlezinger | |
| 2021/0096185 | A1* | 4/2021 | Adkins | H01H 9/16 |
| 2021/0098214 | A1* | 4/2021 | Carlson | H01H 47/001 |
| 2021/0099108 | A1* | 4/2021 | Dziekonski | H02P 1/10 |
| 2021/0319967 | A1* | 10/2021 | Carlson | H01H 47/325 |
| 2021/0388792 | A1* | 12/2021 | Stretch | H01F 7/1844 |

FOREIGN PATENT DOCUMENTS

| | | | | | |
|---|---|---|---|---|---|
| CN | 210837600 | | * | 6/2020 | |
| DE | 10-2016-220190 | A1 | | 4/2018 | |
| EP | 0908904 | A2 | * | 4/1999 | H01F 7/1844 |
| GB | 2400161 | A | * | 10/2004 | F15B 13/0433 |
| GB | 2492190 | A | * | 12/2012 | H01F 7/1844 |
| JP | H1047140 | A | | 2/1998 | |
| WO | WO-2020088799 | A1 | * | 5/2020 | F01L 1/047 |

OTHER PUBLICATIONS

European Search Report dated Jan. 5, 2022 for EP Application No. 21180356.4, 12 Pages.

* cited by examiner

DETECTING A POSITION OF AN ARMATURE IN AN ELECTROMAGNETIC ACTUATOR

BACKGROUND

The present disclosure relates generally to switching devices, and more particularly to sensing properties associated with the switching devices. Switching devices are generally used throughout industrial, commercial, material handling, process and manufacturing settings, to mention only a few. As used herein, "switching device" is generally intended to describe any electromechanical switching device, such as mechanical switching devices (e.g., a contactor, a relay, latching relay, air break devices, and controlled atmosphere devices) or solid-state devices (e.g., a silicon-controlled rectifier (SCR)). More specifically, switching devices generally open to disconnect electric power from a load and close to connect electric power to the load. For example, switching devices may connect and disconnect three-phase electric power to an electric motor.

A latching switch may maintain a particular state (e.g., open or closed) independent of power supplied to the latching switch. However, the armature position of the latching switch can change based on a user's interaction (e.g., manual reset) with the latching switch. Regardless of the position (e.g., open or closed) of the armature of the latching switch, it may be desired to detect the position of the armature without physically examining the latching switch.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system may include an armature configured to move between a first position that electrically couples the armature to a first contact and a second position that electrically couples the armature to a second contact. The system may also include a coil configured receive a current, such that the current conducting in the coil is configured to magnetize a core. The magnetized core may cause the armature to move from the first position to the second position. The system may also include a control system configured to detect a position of the armature based on an inductance of the coil.

In another embodiment, a method may include sending, via circuitry, a plurality of gate signals to a plurality of switches that may cause the plurality of switches to open. The plurality of switches may be part of an H-bridge circuit. The method also includes sending, via the circuitry, a first signal to a first switch, such that the first signal is configured to cause the first switch to close. The method may then involve sending, via the circuitry, a pulse-width modulated signal to a second switch that is part of the H-bridge circuit and measuring, via the circuitry, a current conducting via the first switch while the pulse-width modulated signal is provided to the second switch. The current corresponds to a state of an actuator coil.

In yet another embodiment, a circuit may include a plurality of switches that may be part of an H-bridge circuit and a coil that may magnetize a core of an actuator based on a current conducting in the coil. The circuit may also include a diode configured to couple to the coil, a resistor configured to couple to the diode, and a switch that may couple to the resistor. The switch may close and conduct the current received from the coil.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
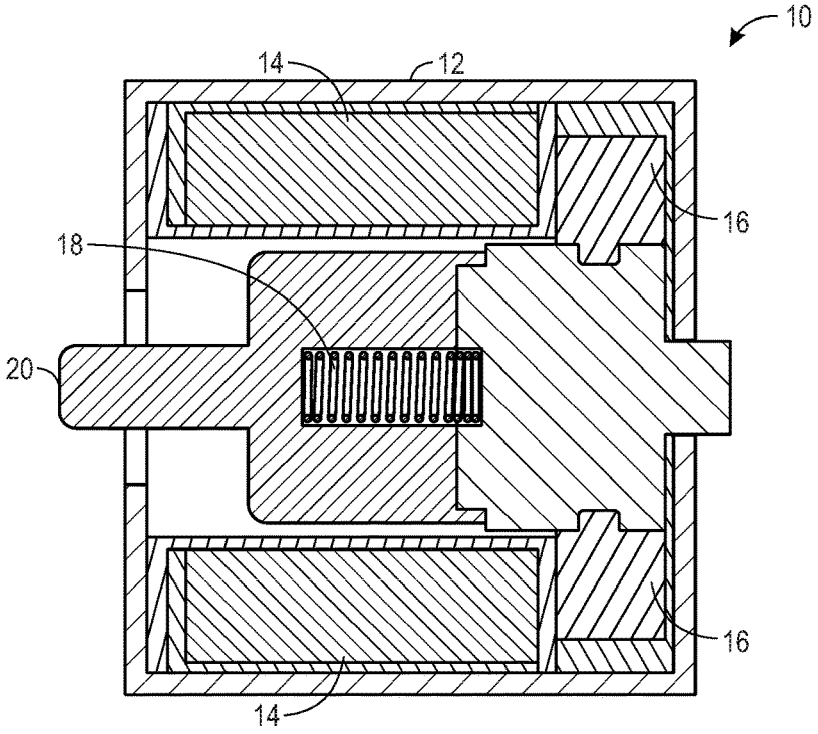
FIG. 1 is a diagrammatical representation of a latching solenoid in a latched position, in accordance with an embodiment.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As described above, switching devices are used in various implementations, such as industrial, commercial, material handling, manufacturing, power conversion, and/or power distribution, to connect and/or disconnect electric power from a load. For example, a number of switching devices may be used to control operations, monitor conditions, and perform other operations related to various equipment in an industrial automation system. As such, the switching devices may be used to coordinate operations across a number of devices With the foregoing in mind, it should be noted that the open operation of the switching device generally depends on a coil current and a core flux of a coil that induces a magnetic field in the switching device. Some types of switching devices include a latching mechanism that enable the switching device to remain in a particular position (e.g., open or closed) regardless of whether power (e.g., coil current) is present on the switching device. The latching switching device, however, can change states when a user interacts with the latching switching device using a manual reset operation or the like. Often times, when the user resets the latching switching device, a control system or other remote monitoring system may not be aware of the state (e.g., open or closed) change of the latching switching device without the use of position sensors or other hardware components that monitor the position of an armature in the switching device. As such, the present embodiments disclosed herein are related to systems and methods for detecting the armature position of a switching device without the use of position sensor hardware. Additional details with regard to determining the armature position of an armature in a switching device will be described below with reference to FIGS. 1-11.

By way of introduction, FIG. 1 depicts a latching solenoid 10 in a latched position. The latching solenoid 10 may be any suitable switch mechanism or electromagnetic actuator with a latching feature. As such, the latching solenoid 10 may include a housing 12, a coil 14, a magnet 16, a spring 18, and an armature 20. The coil 14 may be electrically coupled to a power source that provides a current through the coil 14. The current in the coil 14 may induce a magnetic field or flux in a core of the armature 20 that interacts with the magnet 16 and causes the spring 18 and the armature 20 to move. Indeed, the armature 20 may be coupled to the spring 18, such that both components move together.

The latching solenoid 10 may also include a latching mechanism that causes the spring 18, the armature 20, or both to lock or latch into a fixed position. For example, FIG. 1 illustrates the spring 18 in a compressed position and the armature 20 pulled into the housing 12 of the latching solenoid 10. The latching mechanism may include a hook, a groove, or some suitable mechanical feature that fixes a position of the spring 18 in a compressed orientation. The latching solenoid 10 may also be secured to a latched position using the magnet 16. Although the armature 20 and the spring 18 is described in a particular configuration (e.g., compressed, inside housing), the armature 20 and the spring 18 may be configured in any suitable arrangement according to a variety of embodiments for implementing the latching solenoid 10.

Figure 2:
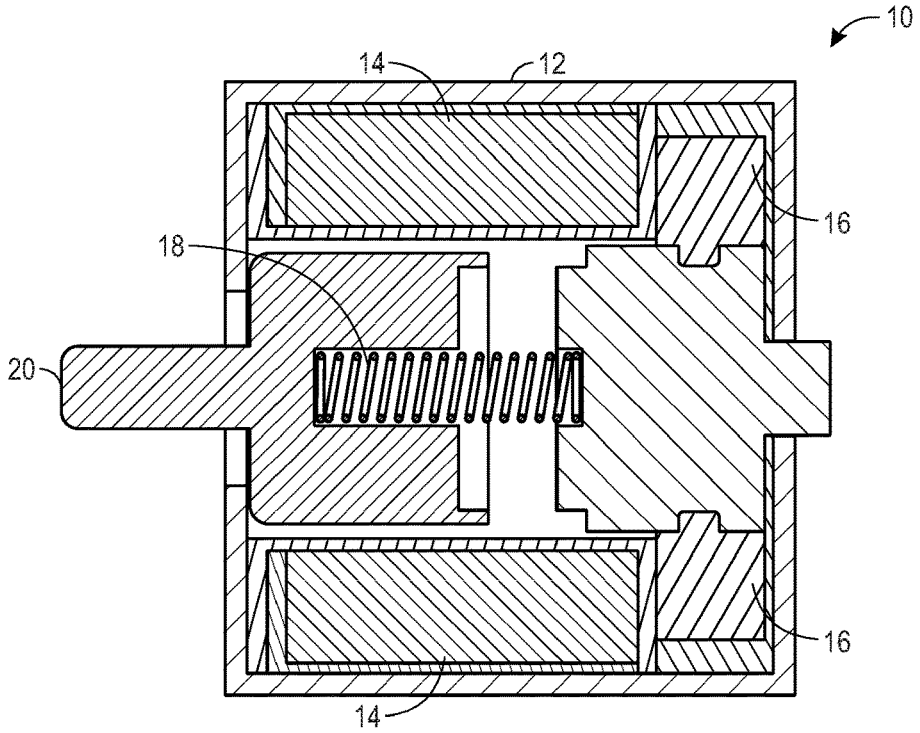
FIG. 2 is a similar diagrammatical representation of the latching solenoid in an unlatched position, in accordance with an embodiment.
Figure 3:
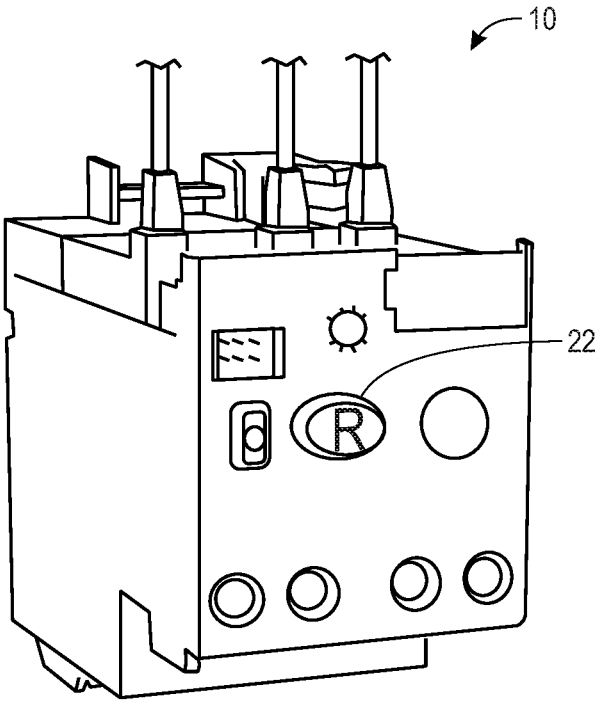
FIG. 3 is a an example enclosure for the latching solenoid depicted in FIGS. 1 and 2, in accordance with an embodiment.

Based on the magnetic field induced by the current in the coil 14, the armature 20 may move between positions as shown in FIG. 1 and FIG. 2. In some embodiments, the armature 20 may include a first contact that may be electrically coupled to a second contact when in a latched position and to a third contact when in a de-latched position based on the movement of the armature 20. As such, the latching solenoid 10 may act as a switch or relay controlling an electrical connection between two nodes. In some embodiments, the magnetic field induced by the current in the coil 14 may cause the spring 18 to compress and fix the armature 20 in a latched position, as shown in FIG. 1. In this case, the latching solenoid 10 may be de-latched based on a user input received via a mechanical input device (e.g., button) disposed on the housing 12. FIG. 3 illustrates an example of a latching solenoid 10 that includes a button 22 that may be used to latch or de-latch the spring 18 and/or the armature 20.

The latching solenoid 10 may interface with a number of electrical components, such as low-voltage circuitry, a microcontroller/microprocessor, and the like. In addition, the button 22 may provide a physical component that a user may access to manually perform operations for the latching solenoid 10 regardless of the current present on the coil 14. By way of example, the button 22 may be a trip or reset button for overload products. For a number of overload products (e.g., overload relays.), power to the latching solenoid 10 may be lost when an overload/trip fault is present. In this condition, the button 22 may be used to maintain a state (e.g., latched or de-latched) of the latching solenoid 10 when left at rest, while allowing for user to be able to modify the position of the armature 20 when pressed independent of the power provided to the latching solenoid 10.

With this in mind, it should be noted that although the current in the coil 14 may cause the armature 20 to move into the latched position, the removal of the current in the coil 14 may not cause the armature 20 to move again since it is latched in a fixed position. That is, the latching mechanism that mechanically latches or holds the armature 20 in a particular position after the core magnetizes of the armature 20 magnetizes, thereby causing the armature 20 to change positions. Alternatively, the latching mechanism may also be configured to mechanically latch or hold the armature 20 in a particular position after the coil 14 demagnetizes and the armature 20 changes position. In any case, the latching mechanism may be released via manual interaction by a user, thereby causing the armature 20 to move positions. However, as discussed above, the change in the position of the armature 20 may not be detected by a control system or monitor system without the use of additional sensors that monitor the position of the armature 20. That is, the presence of current or the lack of the current in the coil 14 may not be indicative of whether the armature 20 is in the latched position. As such, the embodiments described herein may be used to detect the position of the armature 20 of the latching solenoid 10 without the use of additional sensors.

Figure 4:
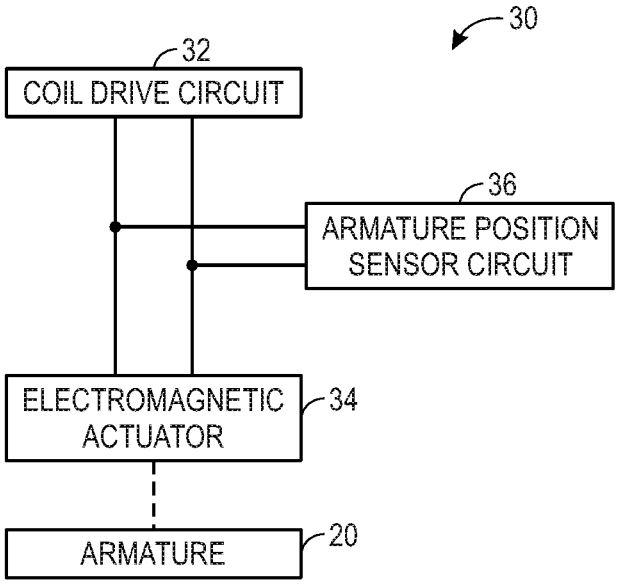
FIG. 4 is a block diagram of an armature position detection system, in accordance with an embodiment.

With this in mind, FIG. 4 illustrates block diagram of an armature position detection system 30 that may be used to detect a position of the armature 20 in the latching solenoid 10 or any suitable electromagnetic actuator. As shown in FIG. 4, the armature position detection system 30 may include a coil drive circuit 32 that may provide a coil current to an electromagnetic actuator 34. The electromagnetic actuator 34 may correspond to the latching solenoid 10 described above. In any case, the coil drive circuit 32 may provide a coil current to a coil within the electromagnetic actuator 34 to cause a core of the electromagnetic actuator 34 to magnetize. The magnetic field induced by the core of the electromagnetic actuator 34 may case the armature 20 to change positions (e.g., open or close).

In one embodiment, the armature position detection system 30 may include an armature position sensor circuit 36. The armature position sensor circuit 36 may generally monitor the inductance of the coil in the electromagnetic actuator 34 to sense the position of the armature 20. In some embodiments, the armature position sensor circuit 36 may provide a pulse-width-modulated signal to the coil of the electromagnetic actuator 34 and determine the position of the armature 20 based on electrical properties (e.g., inductance) of the electromagnetic actuator 34.

Figure 5:
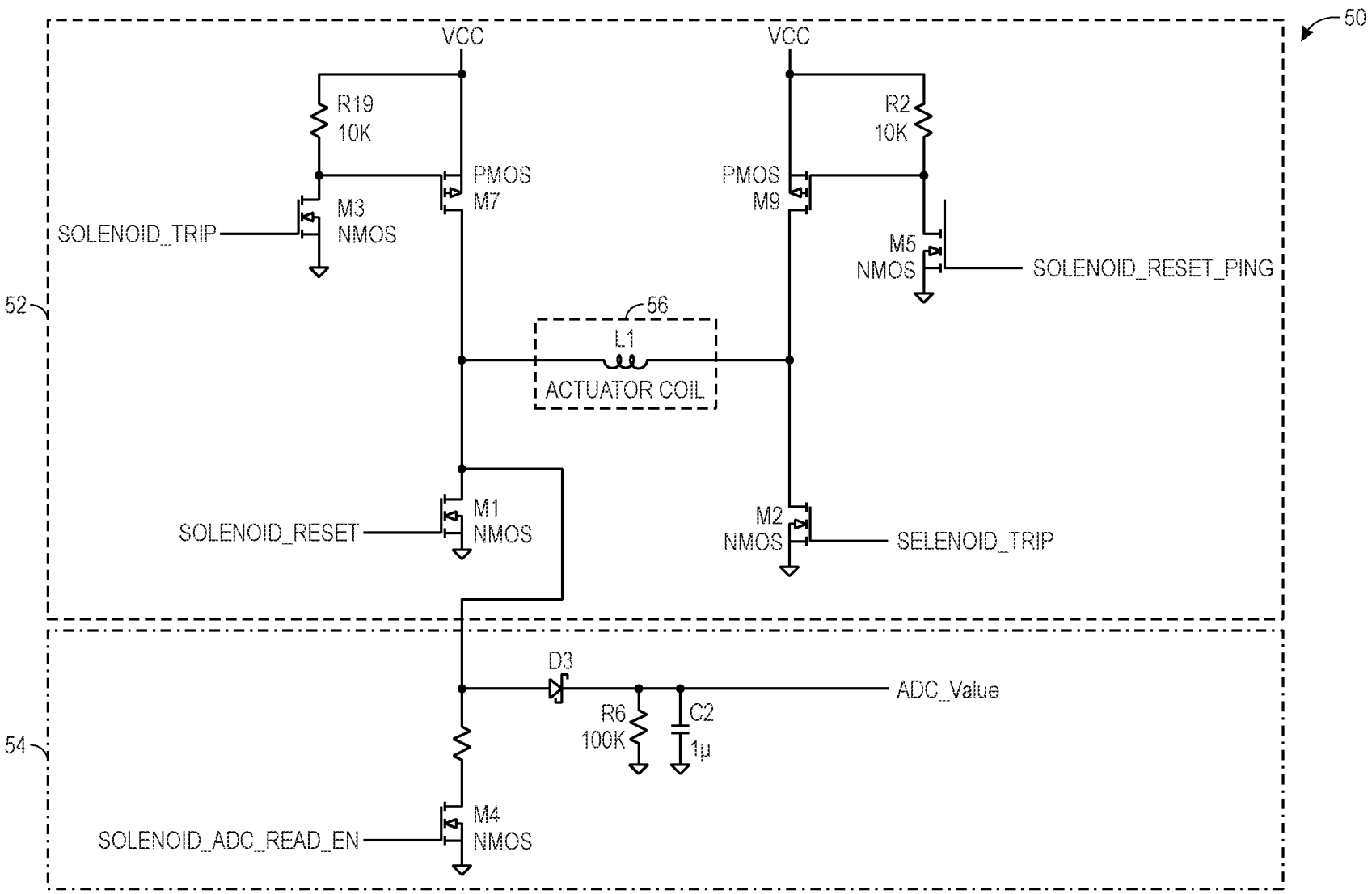
FIG. 5 is a circuit diagram of a coil drive circuit and an armature position sensor circuit, in accordance with an embodiment.

Keeping this in mind, FIG. 5 illustrates an example circuit 50 for controlling the operation of the electromagnetic actuator 34. In some embodiments, the armature position detection circuit 30 may be implemented via the circuit 50. As shown in FIG. 5, the circuit 50 may include an H-bridge circuit 52 that may control a polarity of a voltage or a direction of current flow to a coil of the electromagnetic actuator 34. Additionally, the circuit 50 may include a measurement circuit 54, which may be enabled to detect a position of the armature 20.

Figure 6:
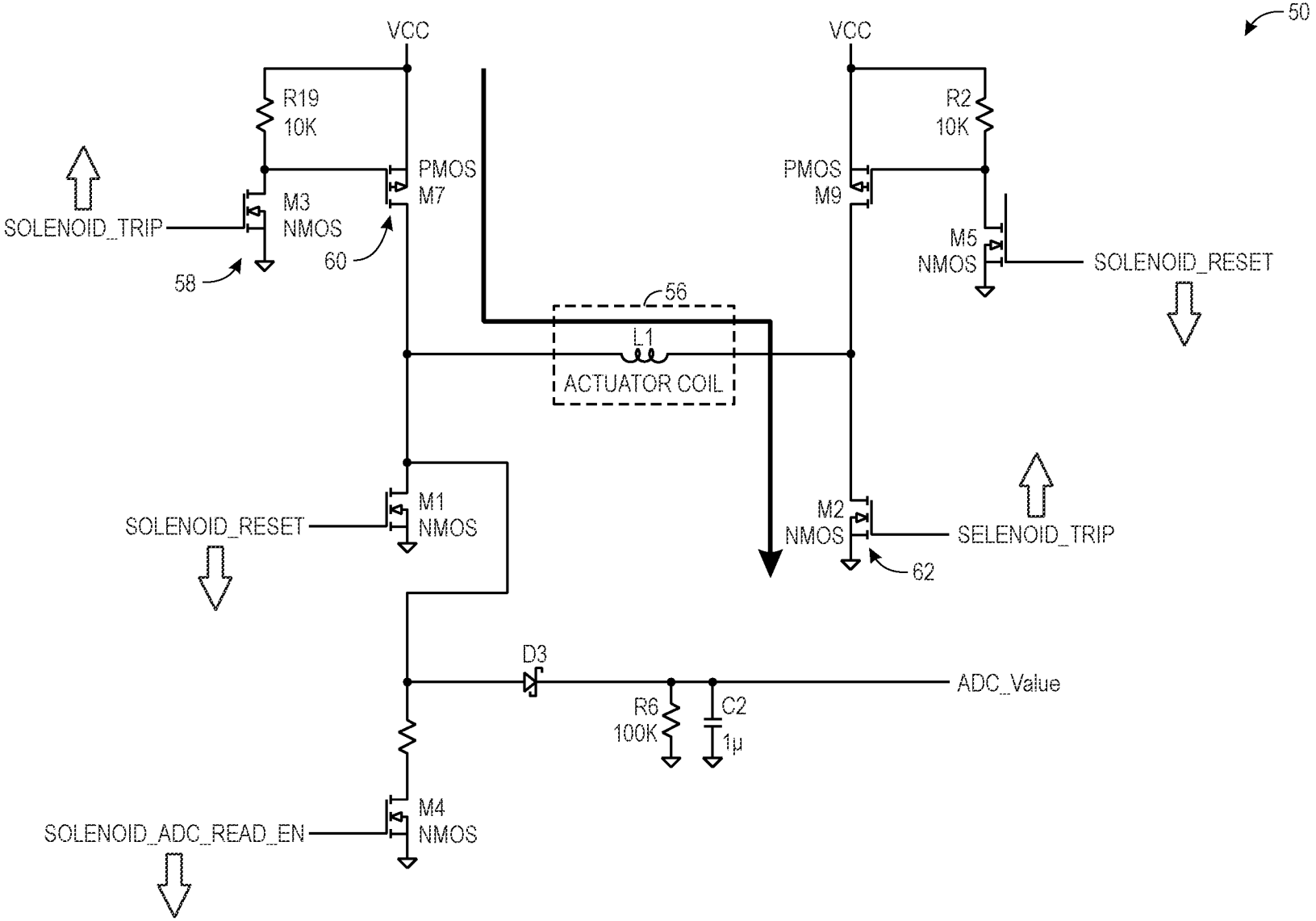
FIG. 6 illustrate a first current flow in a circuit diagram of a coil drive circuit and an armature position sensor circuit, in accordance with an embodiment.

The H-bridge circuit 52 may be connected to an actuator coil 56, which may be part of the electromagnetic actuator 34. By way of operation, one side of the H-bridge circuit 52 may be used to trip or induce a magnetic field in the core of the electromagnetic actuator 34, and the other side of the H-bridge circuit 52 may be used to reset or remove the magnetic field in the core of the electromagnetic actuator 34. For example, FIG. 6 illustrates an operation in which the H-bridge circuit 52 is used to trip the electromagnetic actuator 34. That is, a control system or any suitable computing device may supply a solenoid trip signal (e.g., high signal) to a gate of an NMOS switch 58 to cause the NMOS switch 58 to close, thereby connecting a low signal (e.g., ground) to a gate of a PMOS switch 60. In turn, the PMOS switch 60 may close and provide a voltage to the actuator coil 56. The control system may also provide a solenoid trip signal (e.g., high signal) to an NMOS switch 62, thereby providing a current path from a voltage source Vcc to ground via the actuator coil 56. The current supplied to the actuator coil 56 may magnetize the core of the electromagnetic actuator 34, thereby causing the armature 20 to change states.

Figure 7:
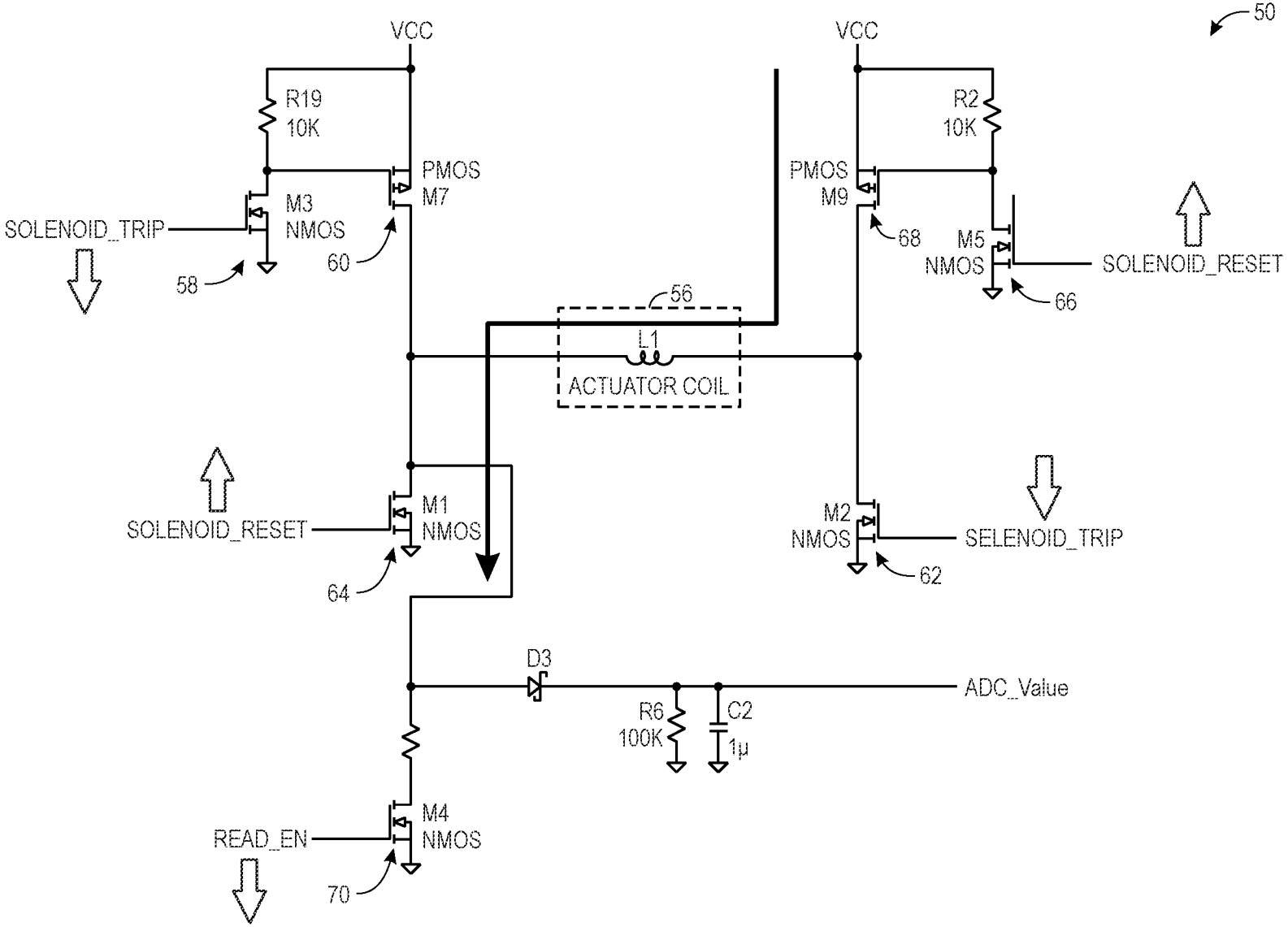
FIG. 7 illustrate a second current flow in a circuit diagram of a coil drive circuit and an armature position sensor circuit, in accordance with an embodiment.

To reset the position of the armature 20, the opposite side of the H-bridge circuit 52 may be driven, as illustrated in FIG. 7. For instance, the control system may remove the solenoid trip signals (e.g., low signal) from gates of NMOS switch 58 and NMOS switch 62. Additionally, the control system may provide solenoid reset signals (e.g., high signals) to gates of NMOS switch 64 and NMOS switch 66. In response to receiving the solenoid reset signals, the NMOS switch 64 and the NMOS switch 66 may close, thereby connecting a low signal (e.g., ground) to a gate of the PMOS switch 68. In this way, the current supplied to the actuator coil 56 may be reversed, as compared to the operation of the H-bridge circuit 52 depicted in FIG. 6. The reversal of the current flow in the actuator coil 56 may cause the armature 20 to move to an opposite position, as compared to the position achieved with the circuit operation depicted in FIG. 6.

Figure 8:
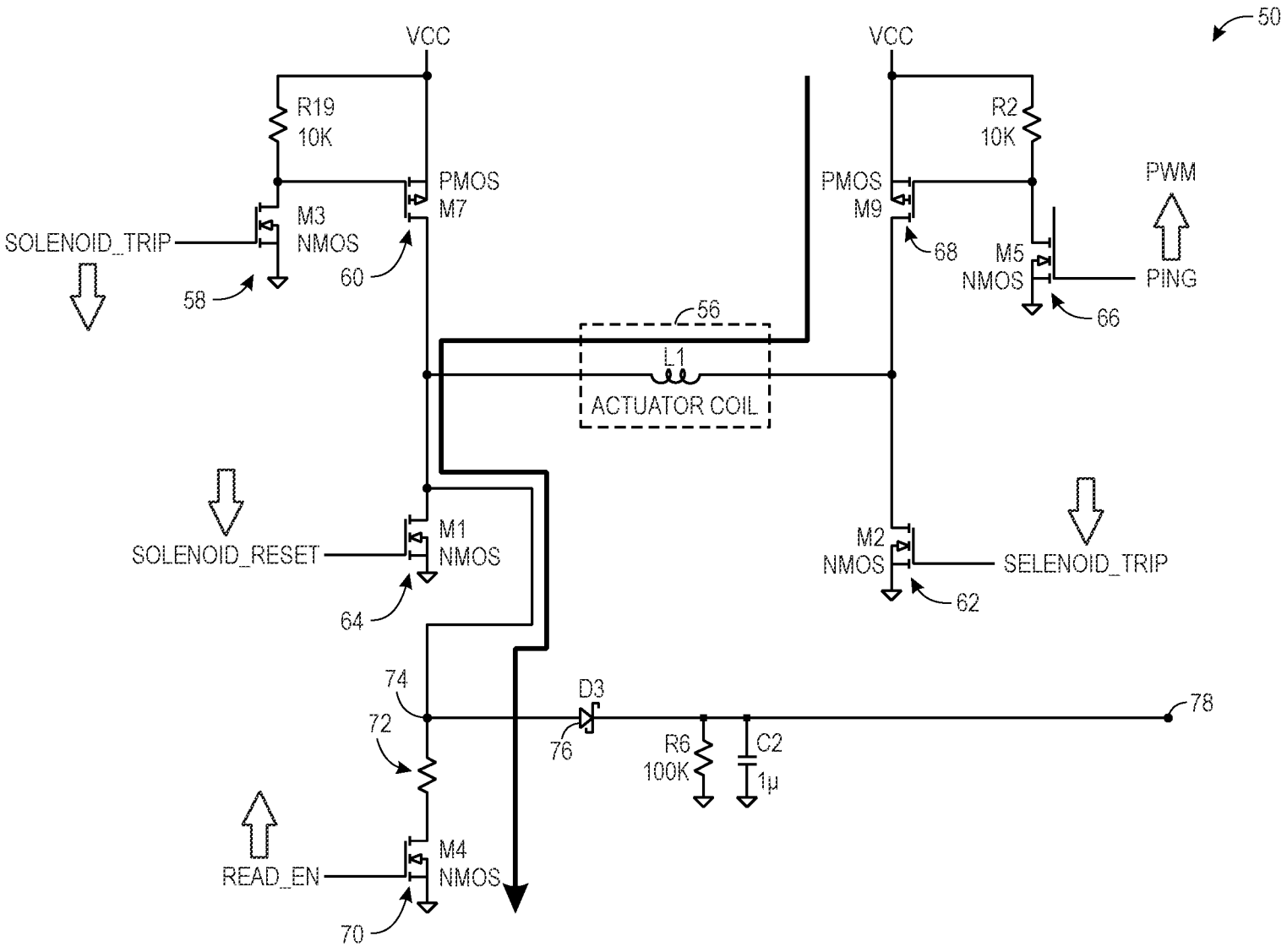
FIG. 8 illustrate a third current flow in a circuit diagram of a coil drive circuit and an armature position sensor circuit, in accordance with an embodiment.

In both modes of operations depicted in FIGS. 6 and 7, the measurement circuit 54 is disabled by connecting a low signal to a gate of NMOS switch 70. That is, the coil current in the modes of operations depicted in FIGS. 6 and 7 flow to a ground connection provided via NMOS switch 64 or NMOS switch 62. However, to detect a position of the armature 20 using the circuit 50, the control system may provide a read enable signal (e.g., high signal) to a gate of the NMOS switch 70, as depicted in FIG. 8.

In addition to providing the read enable signal, the control system may provide a ping signal to the NMOS switch 66. The ping signal may be a pulse-width modulated signal that cycles between a high voltage value and a low voltage value over a period of time. For example, the pulse-width modulated signal may be a voltage signal provided at 20 kHz and a 10% duty cycle. To deactivate the operation of the H-bridge circuit 52, the control system may remove the solenoid trip signals and the solenoid reset signal from the NMOS switch 158, the NMOS switch 62, and the NMOS switch 64.

By providing the read enable signal (e.g., high signal) to the gate of the NMOS switch 70, the control system may cause the NMOS switch 70 to close thereby providing a current path to ground for the coil current conducting within the actuator coil 56. Since the ping signal consists of a pulse-width modulated signal, the coil current through the actuator coil 56 is pulsed through a resistive load (e.g., resistor 172) in the measurement circuit 54. Based on the voltage present at node 74 in the measurement circuit 54, a diode 76 may be used to rectify or convert the voltage into a digital signal that may be measured at output node 78. The voltage measured at the output node 78 is dependent on the inductance of the actuator coil 56. With this in mind, it should be noted that the position of the armature 20 is also dependent on the inductance of the actuator coil 56. As such, based on the detected voltage signal at the output node 78, the control system or any suitable computing device may detect the position (e.g., open or closed) of the armature 20. It should be noted that the diode 76 may be any suitable diode such as a Schottky diode, a Zener diode, or the like.

Figure 9:
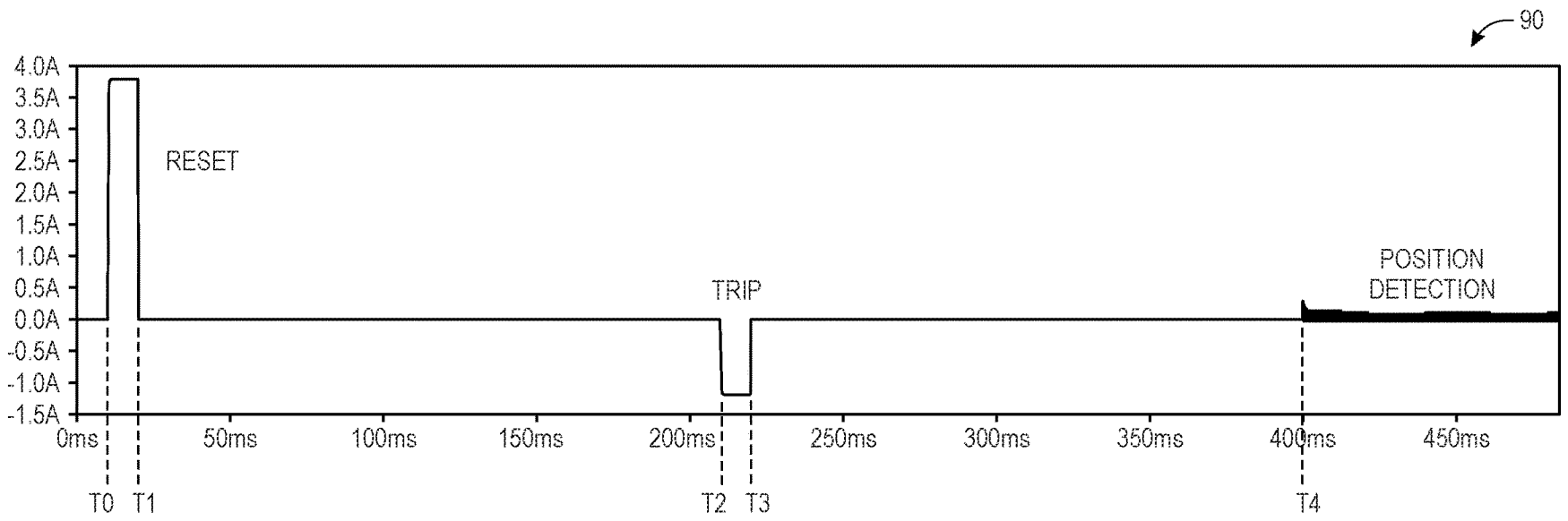
FIG. 9 illustrates a current over time graph that depicts waveforms detected during a position sensing operation, in accordance with an embodiment.

For instance, FIG. 9 illustrates a timing diagram 90 that depicts the current detected at the node 74 during a trip operation, a reset operation, and a measurement detection operation of the example circuit 50. Referring to FIG. 9, between time t0 and time t1, the solenoid reset signal may be provided to the NMOS switch 66 and the NMOS switch 64. As such, the coil current of the actuator coil 56 may be a positive value (e.g., ~3.7 A). During the trip operation, the solenoid trip signal may be provided to the NMOS switch 58 and the NMOS switch 62 (solenoid reset signal removed from the NMOS switch 66 and the NMOS switch 64). As a result, the coil current of the actuator coil 56 may be a negative value (e.g., ~−1.2 A).

At time t4, the measurement circuit 54 may be activated as described above with reference to FIG. 8. As shown in FIG. 8, the detected coil current during position sensing has a relatively lower magnitude, as compared to the current magnitudes during the reset operation and the trip operation. In this way, the coil current is low enough to avoid affecting the trip or reset operations of the electromagnetic actuator.

Figure 10:
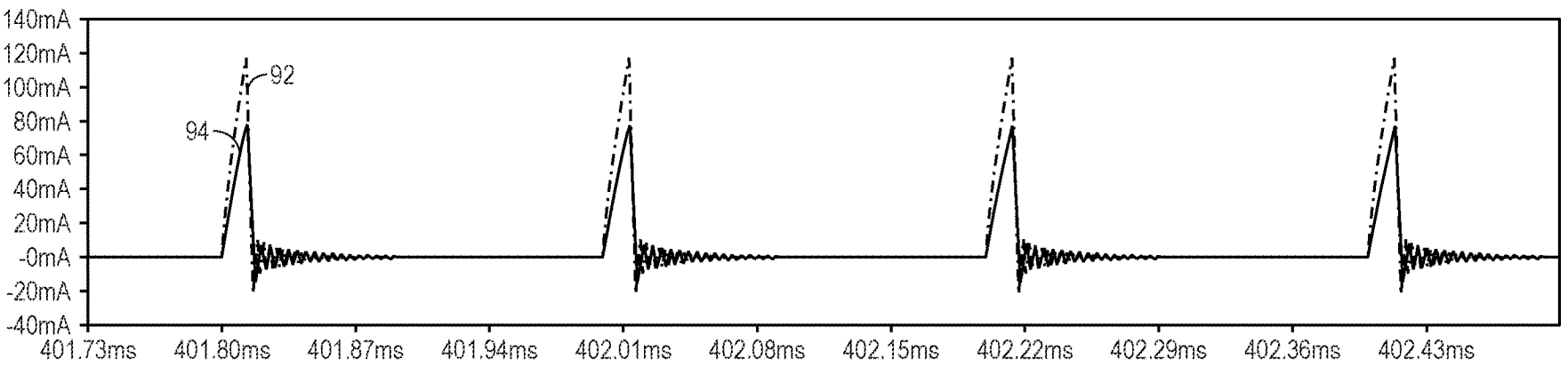
FIG. 10 illustrates a current over time graph that depicts waveforms detected during a position sensing operation, in accordance with an embodiment.

FIG. 12 illustrates a scaled view of the measured current at time t4. As shown in FIG. 10, a first current trace 92 achieves a higher peak value, as compared to a second current trace 94. The first current trace 92 may correspond to a situation in which the armature 20 is in an open position and the core of the electromagnetic actuator 34 is not magnetized. That is, since the core of the electromagnetic actuator 34 is not magnetized, the inductance of the actuator coil 56 is higher than when the core of the electromagnetic actuator 34 is magnetized. This lower inductance causes the peak current to be greater than the peak current of the second current trace 94, which corresponds to when the armature 20 is in a closed position. That is, when the armature 20 is in the closed position, the inductance of the actuator coil 56 is lower than when the core of the electromagnetic actuator 34 is not magnetized.

Figure 11:
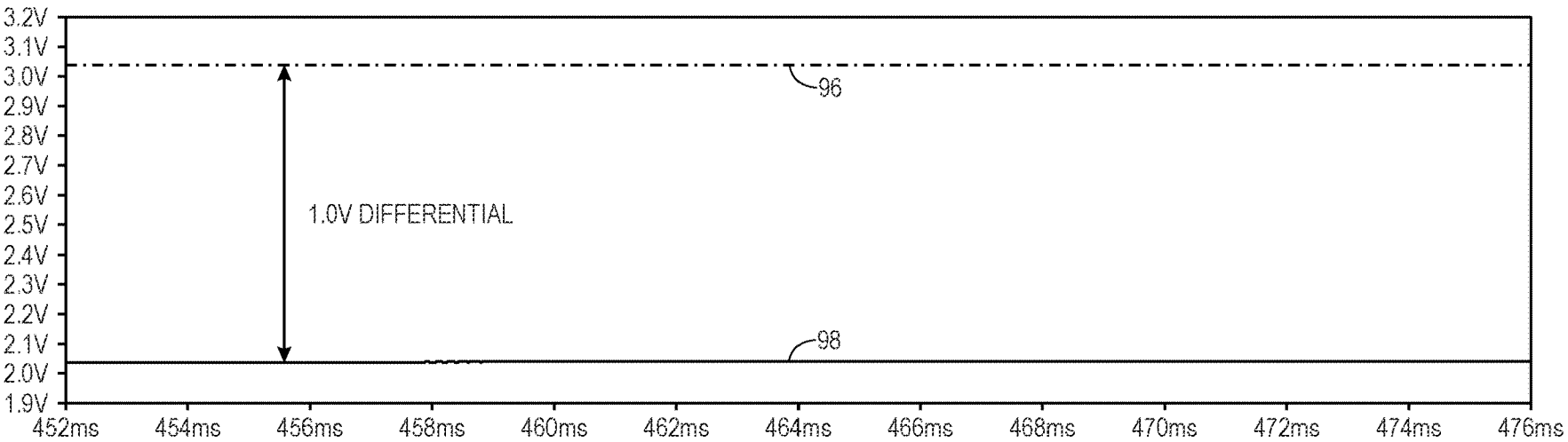
FIG. 11 illustrates a voltage over time graph that corresponds to a position sensing operation, in accordance with an embodiment.

Although the different peak values may be difficult to determine based on the analog values measured at the node 74, the diode 76 may rectify the coil current received at the node 74 to produce digital values, as shown in FIG. 11. Indeed, the first current trace 92, which corresponds to armature 20 being in an open position may correspond to a voltage signal 96. Additionally, the second current trace 94, which corresponds to armature 20 being in a closed position may correspond to a voltage signal 98. As depicted in FIG. 11, the one-volt difference between the two voltage signals may be used to provide a digital indication of the position of the armature 20. Namely, the high voltage level may correspond to the armature 20 being in an open position and the low voltage level may correspond to the armature 20 being in a closed position.

Although the preceding discussion of the operation of the example circuit 50 is detailed using NMOS switches and PMOS switches, it should be understood that any suitable switching technology (e.g., MOSFET, IGBT, BJT) may be employed to perform the operations of the circuit 50. Indeed, the NMOS switches can be changed to PMOS switches, and vice-versa, so long as the gate signals change accordingly. In any case, it should be noted that the switches illustrated in FIGS. 5-8 are provided as example switches, and the present disclosure should not be limited to the embodiments described in those figures.

With the foregoing in mind, the control system may remotely access or the electromagnetic actuator 34 to determine the position of the armature 20. Indeed, the remote detection of the position of the armature 20 may enable users to know the state of the electromagnetic actuator 34 regardless of whether a user has manually changed the state of the actuator. That is, the control system may leverage the inductance of the actuator coil 56 to remotely determine the position of the armature 20. In some embodiments, the control system may then update a visualization to be presented via a display, send a notification to another computing device, or perform any other suitable operation to provide an indication regarding the position of the armature 20. In some embodiments, the control system may determine whether the detected state of the armature 20 matches an expected state of the armature 20. If not, the control system may send solenoid trip or solenoid reset signals to respective gates of switches to cause the H-bridge circuit 52 to change state of the electromagnetic actuator 34 to match the expected state. In this way, the control system may remotely control the operation of the electromagnetic actuator 34, while also remotely detecting the position of the armature 20 without using additional hardware.

It should be noted that the gate signals may be provided via a control system or any suitable computing device. As such, the control system may include any suitable computing system, controller, or the like. By way of example, the control system may include a communication component, a processor, a memory, a storage, input/output (I/O) ports, a display, and the like. The communication component may be a wireless or wired communication component that may facilitate communication between different components within the industrial automation system, to the electromagnetic actuator 134, or the like.

The processor may be any type of computer processor or microprocessor capable of executing computer-executable code. The processor may also include multiple processors that may perform the operations described below. The memory and the storage may be any suitable articles of manufacture that can serve as media to store processor-executable code, data, or the like. These articles of manufacture may represent computer-readable media (e.g., any suitable form of memory or storage) that may store the processor-executable code used by the processor to perform the presently disclosed techniques. The memory and the storage may represent non-transitory computer-readable media (e.g., any suitable form of memory or storage) that may store the processor-executable code used by the processor to perform various techniques described herein. It should be noted that non-transitory merely indicates that the media is tangible and not a signal.

The I/O ports may be interfaces that may couple to other peripheral components such as input devices (e.g., keyboard, mouse), sensors, input/output (I/O) modules, and the like. The display may operate to depict visualizations associated with software or executable code being processed by the processor. In one embodiment, the display may be a touch display capable of receiving inputs from a user. The display may be any suitable type of display, such as a liquid crystal display (LCD), plasma display, or an organic light emitting diode (OLED) display, for example. Additionally, in one embodiment, the display may be provided in conjunction with a touch-sensitive mechanism (e.g., a touch screen) that may function as part of a control interface. It should be noted that the components described above with regard to the control system are exemplary components and the control system may include additional or fewer components as shown.

Technical effects of the embodiments described herein include providing the ability to remotely detect a position of an armature in an electromagnetic actuator without employing position sensing circuitry, such as optocouplers and the like. Indeed, the position of the armature may be detected remotely by providing a pulse-width modulated signal to the actuator coil and measuring a digital voltage output that changes based on the inductance of the actuator coil. In this way, present embodiments described herein may provide systems and methods for detecting the position of the armature without including additional sensing circuitry.

It should be noted that although certain embodiments described herein are described in the context or contacts that are part of a latching solenoid or relay device, it should be understood that the embodiments described herein may also be implemented in suitable contactors and other switching components. Moreover, it should be noted that each of the embodiments described in various subsections herein, may be implemented independently or in conjunction with various other embodiments detailed in different subsections to achieve more efficient (e.g., power, time) and predictable devices that may have a longer lifecycle. It should also be noted that while some embodiments described herein are detailed with reference to a particular relay device or contactor described in the specification, it should be understood that these descriptions are provided for the benefit of understanding how certain techniques are implemented. Indeed, the systems and methods described herein are not limited to the specific devices employed in the descriptions above.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system, comprising:

an armature configured to move between a first position that electrically couples the armature to a first contact and a second position that electrically couples the armature to a second contact;

a coil configured to receive a current, wherein the current conducting in the coil is configured to magnetize a core, thereby causing the armature to move from the first position to the second position;

an H-bridge circuit configured to provide the current to the coil; and a control system configured to detect a position of the armature based on an inductance of the coil while a pulse-width modulated current signal is transmitted to the H-bridge circuit, wherein the pulse-width modulated current signal comprises a first magnitude lower than a second magnitude associated with the current and is configured to avoid affecting a movement of the armature between the first position and the second position.

2. The system of claim 1, comprising a measurement circuit configured to detect a measurement of the current.

3. The system of claim 2, wherein the measurement circuit comprises a diode configured to convert the measurement of the current into a voltage value.

4. The system of claim 3, wherein the control system is configured to determine the position of the armature based on the voltage value.

5. The system of claim 2, wherein the measurement circuit comprises a switch configured to receive a gate signal that causes the measurement circuit to detect the measurement of the current.

6. The system of claim 1, wherein the control system is configured to send one or more signals to the H-bridge circuit, wherein the one or more signals is configured to cause the armature to move to the first position or the second position.

7. The system of claim 1, wherein the H-bridge circuit comprises a plurality of switches configured to control a flow of the current through the coil.

8. The system of claim 7, wherein each of the plurality of switches is coupled to ground.

9. A method, comprising:

sending, via circuitry, a plurality of gate signals to a plurality of switches configured to cause the plurality of switches to open, wherein the plurality of switches is part of an H-bridge circuit;

sending, via the circuitry, a first signal to a first switch of the plurality of switches, wherein the first signal is configured to cause the first switch to close;

sending, via circuitry, a second signal to a second switch and a third switch, wherein the second switch and the third switch are positioned on opposite sides of the H-bridge circuit, and wherein the second signal is configured to cause the second switch and the third switch to open;

sending, via circuitry, a third signal to a fourth switch, wherein the fourth switch and the second switch are positioned on opposite sides of the H-bridge circuit, wherein the third signal is configured to cause the fourth switch to open;

sending, via the circuitry, a pulse-width modulated signal to a second switch that is part of the H-bridge circuit; and measuring, via the circuitry, a current conducting via the first switch while the pulse-width modulated signal is provided to the second switch, wherein the current corresponds to a state of an actuator coil.

10. The method of claim 9, wherein each of the plurality of switches comprise a PMOS switch.

11. The method of claim 9, wherein each of the plurality of switches comprise an NMOS switch.

12. A circuit, comprising:

a plurality of switches configured to be part of an H-bridge circuit, wherein one of the plurality of switches is configured to receive a pulse-width modulated signal at a gate of the one of the plurality of switches, wherein the pulse-width modulated signal comprises a 20 kHz and a 10% duty cycle;

a coil configured to magnetize a core of an actuator based on a current conducting in the coil;

a diode configured to couple to the coil;

a resistor configured to couple to the diode; and a switch configured to couple to the resistor, wherein the switch is configured to close and conduct the current received from the coil.

13. The circuit of claim 12, wherein the diode is configured to provide a DC voltage based on the current.

14. The circuit of claim 13, wherein the DC voltage is representative of an inductance of the coil.

15. The circuit of claim 12, wherein the plurality of switches comprises one or more PMOS switches and a plurality of NMOS switches.

16. The circuit of claim 12, comprising a controller configure to output a plurality of signals to control one or more operations of the plurality of switches.

17. The circuit of claim 12, wherein the plurality of switches is configured to control a flow of the current through the coil.

18. The circuit of claim 12, wherein each of the plurality of switches is coupled to ground.

* * * * *